US008469103B2

(12) United States Patent
Barry

(10) Patent No.: US 8,469,103 B2
(45) Date of Patent: Jun. 25, 2013

(54) PLUNGER LIFT WITH CHEMICAL INJECTION

(75) Inventor: David Barry, Bartlesville, OK (US)

(73) Assignee: ABB Inc., Cary, NC (US)

( * ) Notice: Subject to any disclaimer, the term of this patent is extended or adjusted under 35 U.S.C. 154(b) by 366 days.

(21) Appl. No.: 12/841,226

(22) Filed: Jul. 22, 2010

(65) Prior Publication Data

US 2011/0024130 A1 Feb. 3, 2011

Related U.S. Application Data

(60) Provisional application No. 61/229,295, filed on Jul. 29, 2009.

(51) Int. Cl.
*E21B 43/00* (2006.01)
*E21B 37/10* (2006.01)

(52) U.S. Cl.
USPC ... 166/372; 166/105.2; 166/153; 166/250.01; 166/309

(58) Field of Classification Search
USPC ..... 166/250.01, 309, 310, 369, 372, 166/383, 105.2, 153
See application file for complete search history.

(56) References Cited

U.S. PATENT DOCUMENTS

| | | | | |
|---|---|---|---|---|
| 2,773,551 | A * | 12/1956 | Warden et al. | 166/64 |
| 3,228,472 | A * | 1/1966 | Rhoads, Jr. | 166/64 |
| 3,412,798 | A * | 11/1968 | Gregston | 417/56 |
| 3,473,611 | A * | 10/1969 | Gregston | 166/310 |
| 7,004,258 | B2 | 2/2006 | Farris | |
| 7,040,401 | B1 | 5/2006 | McCannon | |
| 7,117,947 | B2 * | 10/2006 | Wilson | 166/372 |
| 7,328,749 | B2 | 2/2008 | Reitz | |
| 7,451,823 | B2 * | 11/2008 | Wilson | 166/372 |
| 7,556,100 | B2 * | 7/2009 | Steiner | 166/279 |
| 2007/0039739 | A1 * | 2/2007 | Wilson | 166/369 |
| 2008/0023203 | A1 * | 1/2008 | Steiner | 166/312 |
| 2011/0024130 | A1 * | 2/2011 | Barry | 166/372 |

* cited by examiner

*Primary Examiner* — Jennifer H Gay
(74) *Attorney, Agent, or Firm* — Denis Ticak; Michael Charles Prewitt

(57) ABSTRACT

A method and system operates a well having an outer casing, a tubing positioned inside the outer casing, and a plunger moveable within the tubing to periodically draw out a liquid slug. A chemical to slug size ratio is set by the operator. Thereafter, the gas flow rate is monitored and the well is shut-in when the gas flow rate drops below a predetermined threshold. After well shut-in, a calculated amount of chemical foaming agent is injected. The size of the liquid slug is calculated and then the well is opened, drawing the plunger and liquid slug up to the surface. The calculated amount of chemical foaming agent is calculated based on one or more previous liquid slug size determinations and the set chemical to slug size ratio.

16 Claims, 4 Drawing Sheets

PLUNGER LIFT WITH CHEMICAL INJECTION

CROSS-REFERENCE TO RELATED APPLICATION

This application claims the benefit of U.S. provisional patent application No. 61/229,295 filed on Jul. 29, 2009, which is hereby incorporated by reference in its entirety.

BACKGROUND

In mature gas wells, the accumulation of fluids in the well can slow and sometimes even halt gas production. Various methods have been employed to remove the accumulated fluids such as foaming chemicals and pumps. One particularly cost affective liquid removal mechanism is a plunger lift system. Through the opening and closing of valves, a plunger lift system uses gas pressure buildup in a well to lift a column of accumulated fluid (hereinafter "the slug") out of a well. The plunger lift system maintains gas production in wells that may otherwise substantially slow, or halt altogether.

While plunger lift systems are very affective, as demonstrated by wide industry acceptance, drawbacks persist. For example, as a well matures, the gas pressure may become insufficient to force a plunger and slug out of a well. At that point, the plunger lift system becomes useless. Thus, there is a need in the art to prolong the effectiveness of plunger lift systems and achieve greater gas well productivity.

SUMMARY OF THE INVENTION

According to one aspect of the present invention, a method is provided for operating a well having an outer casing and a tubing positioned inside the outer casing, a plunger is moveable within the tubing to periodically draw out a liquid slug. The method includes setting a chemical to slug size ratio and monitoring a gas flow rate. The well is shut-in when the gas flow rate drops below a predetermined threshold, the plunger falling to the bottom of the tubing during shut-in. A calculated amount of chemical foaming agent is injected into the tubing after shut-in. The size of the liquid slug is determined. The well is then opened when the casing pressure rises above a predetermined threshold, the plunger being forced to the surface of the well. The calculated amount of chemical foaming agent is calculated based on one or more previous liquid slug size determinations and the set chemical to slug size ratio.

According to another aspect of the present invention an electronic controller device is provided for controlling the operation of a well having an outer casing and a tubing positioned inside the outer casing, a plunger moveable within the tubing to periodically draw out a liquid slug and a chemical injection assembly. The controller includes a processor, one or more storing units for storing signals, and software program instructions which are stored in one or more of the storing units and when executed by the processor cause the electronic controller device to perform a method including receiving the input of a chemical to slug size ratio from an operator and monitoring the flow rate of the gas in the tubing. The well is shut-in when the gas flow rate in the tubing drops below a predetermined threshold, the plunger being allowed to fall to the bottom of the tubing during shut-in. The chemical injection subassembly is instructed to inject a calculated amount of chemical foaming agent into the tubing after shut-in. The size of the liquid slug is determined and the well is opened when the pressure in the casing rises above a predetermined threshold, the plunger thereafter being forced to the surface of the well. The calculated amount of chemical foaming agent is calculated based on one or more previous liquid slug size determinations and the set chemical to slug size ratio.

DETAILED DESCRIPTION OF THE INVENTION

Figure 1:
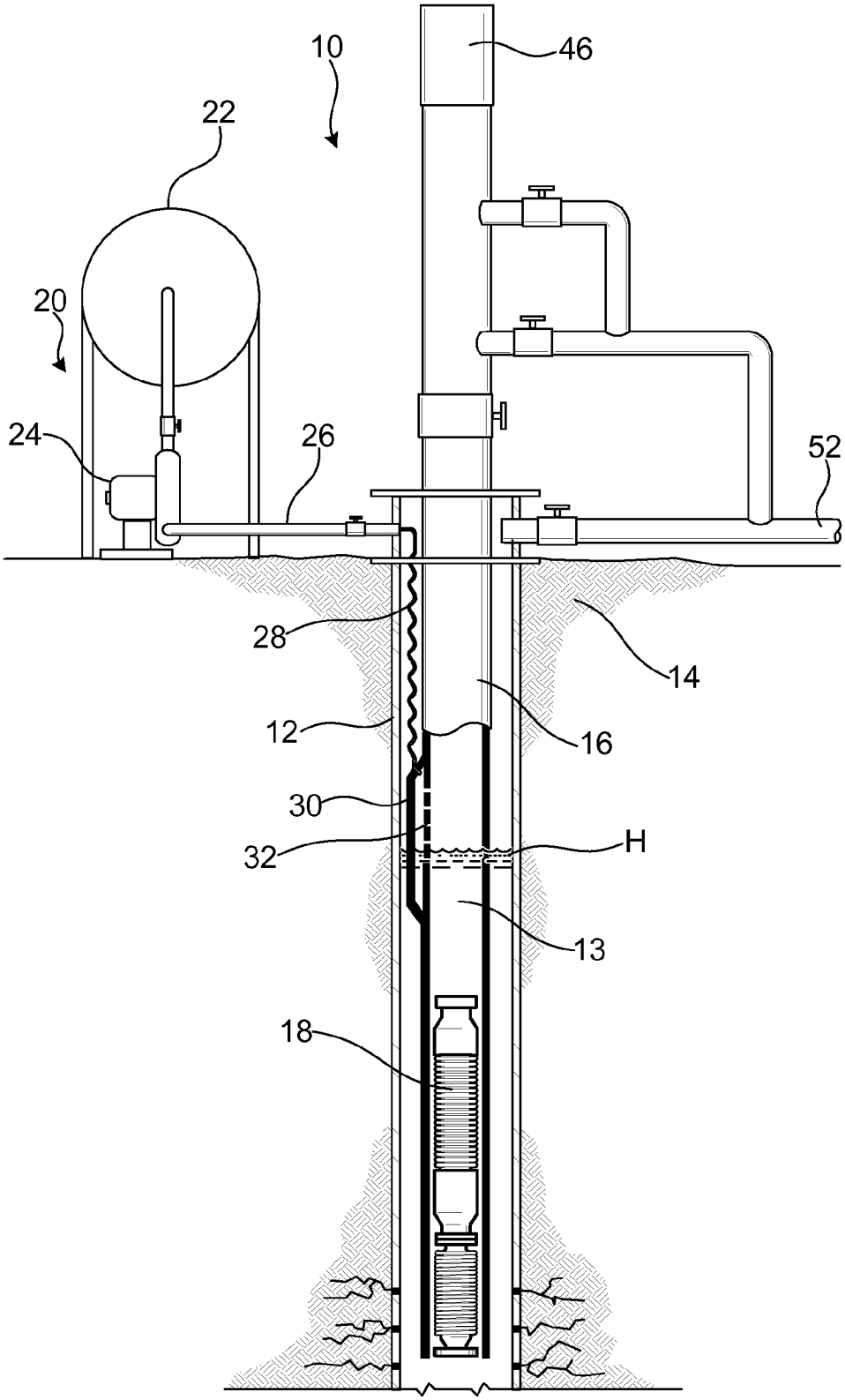
FIG. 1 is a schematic view of a gas well according to the present invention.
Figure 2:
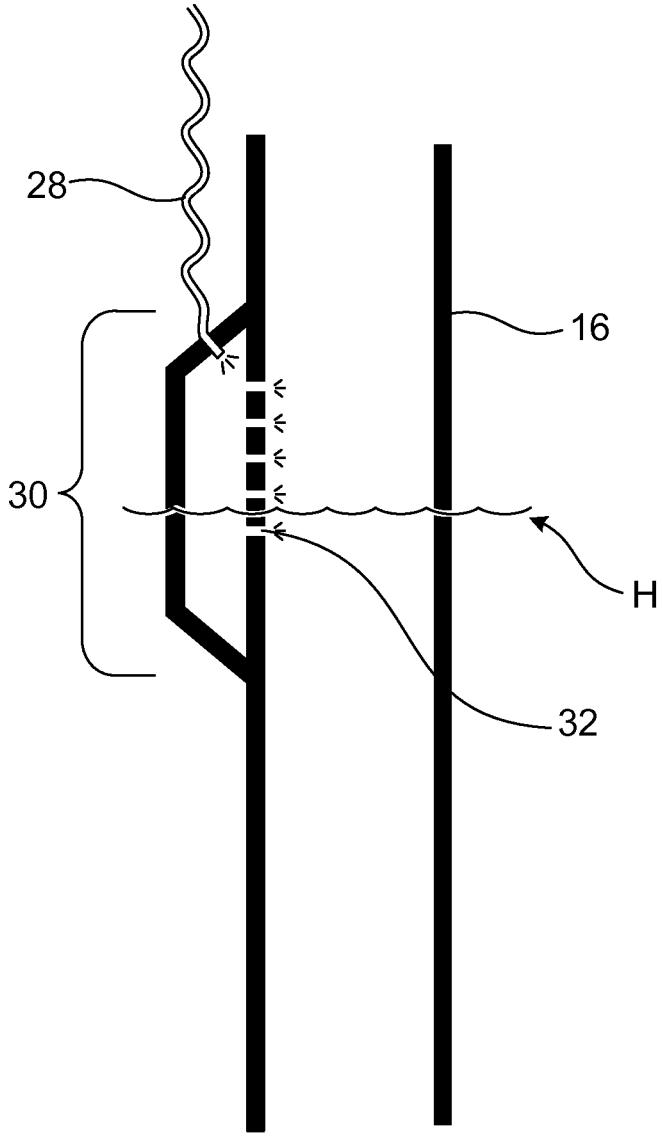
FIG. 2 is an enlarged view of the side string mandrel shown in FIG. 1.
Figure 3:
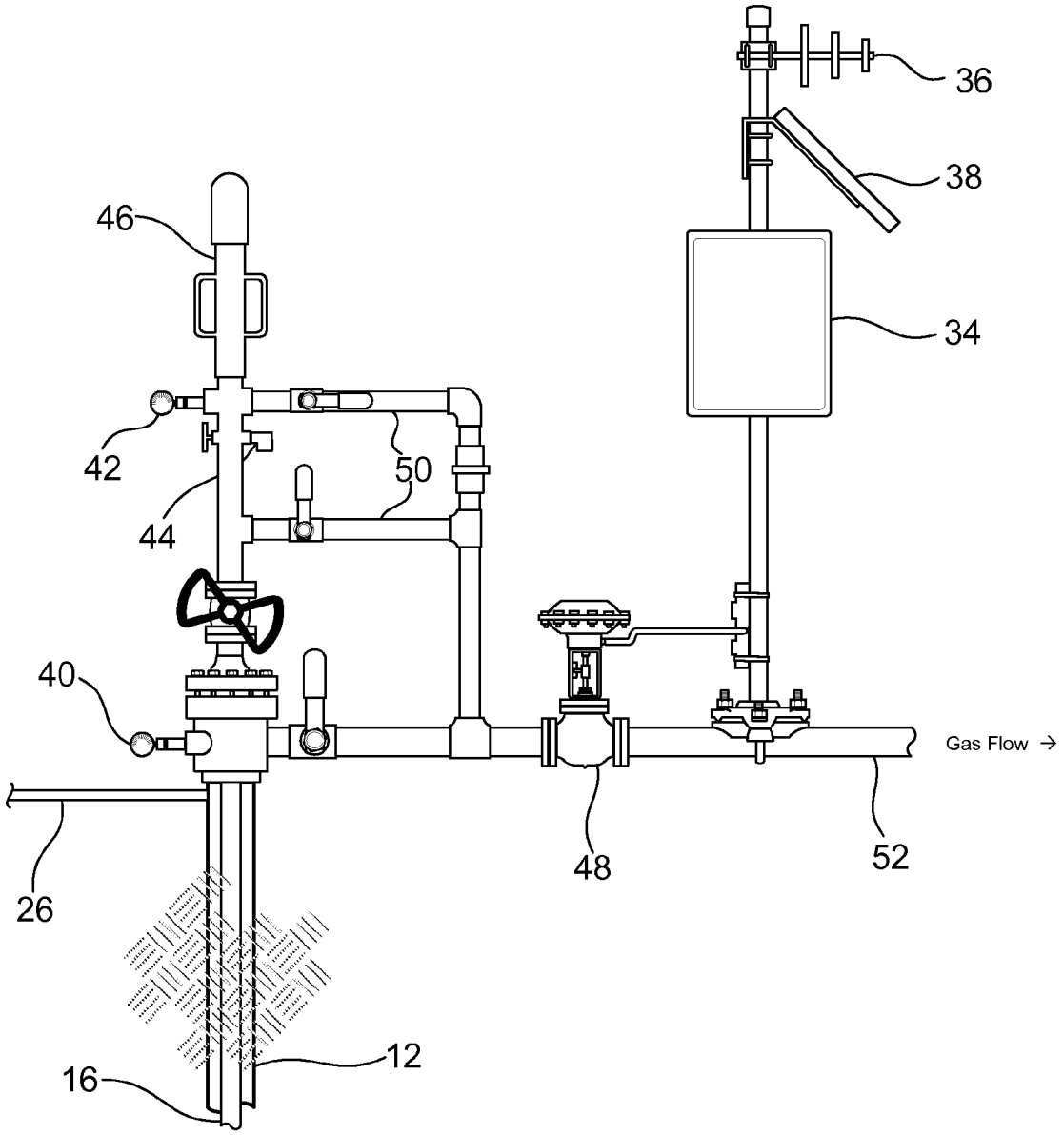
FIG. 3 is an enlarged view of the above-ground portion of the well of FIG. 1.

With reference now to FIGS. 1-3, a gas well is shown and generally indicated by the numeral 10. The well includes a casing 12 extending into the earth 14. Casing 12 provides and maintains the structural integrity of the well. Well 10 extends to a gas zone in the earth, wherein gas exists under pressure. Tubing 16 is positioned within casing 12 and extends substantially the entire length thereof. Tubing 16 is the avenue through which the gas exits the well. Tubing 16 also carries a plunger 18 which, as will be discussed in greater detail below, is movable within tubing 16 to selectively remove a liquid slug from the well.

Well 10 includes a chemical application assembly 20 that selectively adds a chemical foaming agent to the well. Assembly 20 includes a chemical tank 22 for storing the chemical. Chemical tank 22 is in fluid connection with a pump 24. The pump outlet is connected to a pipe 26 that extends to casing 12. Pipe 26 is connected to coiled tubing 28 which extends downward into the well in the area between casing 12 and tubing 16. Coiled tubing 28 terminates at a side string mandrel 30. Mandrel 30 provides one or more openings 32 to the interior of tubing 16. Thus, pump 24 draws chemicals out of tank 22, through pipe 26 to coiled tubing 28 and down into the well where, at the side string mandrel 30, the chemical is added to the interior of tubing 16.

In one or more embodiments, side string mandrel 30 is positioned proximate to the height in the well of the liquid loading height H. In some instances, it may be difficult to determine the exact liquid loading height and/or the liquid loading height may vary. Thus, in some embodiments, the side string mandrel is positioned at or below approximately half the depth of the well. In other embodiments, the side string mandrel is positioned approximately 200 feet from the bottom of the well. The system functions most effectively if side string mandrel 30 is at or slightly above the top of the slug.

With reference now to FIG. 3, a more detailed view of the above-ground well components is shown. A controller 34 is provided that controls the operation of the plunger as well as the chemical injection functions. Controller 34 further acquires a plurality of system measurements, both for review by the operator as well as for purposes of efficiently controlling well operations. Control commands may be received and measurements may be transmitted via an antenna 36. Power is supplied by a hard wired electrical line or, in the present embodiment, via a solar panel 38.

Various monitoring devices are provided to accurately determine system status and performance. A casing pressure gauge 40 measures the pressure within the casing 12 and transmits that measurement to controller 34. A tubing pressure gauge 42 measures the pressure within tubing 16 and transmits that measurement to controller 34. An arrival sensor 44 determines when the plunger 18 arrives at the plunger catcher (lubricator) 46 and transmits that information to the controller 34. A flow rate sensor (not shown) measures the gas flow rate out of the well.

Controller 34 also controls various elements in the system. For example, controller 34 controls chemical pump 24 to selectively provide chemicals to the well interior. Controller 34 also controls a control valve 48 that is connected between a plurality of outlet pipes 50, connected to tubing 16, and the main outlet 52. As will be described in greater detail below, control valve 48 selectively closes-in (i.e. prevents gas from exiting well 10) and opens the well to operate plunger.

The plunger operates in the following manner. In a starting position, plunger 18 is located in the plunger lubricator 46. Gas travels up tubing 16 and through one or more of the outlet pipes 50 (in the present embodiment only the top outlet pipe is open) and exits via the main outlet 52. As gas is produced, liquids accumulate in the well-bore creating a gradual increase in back-pressure that slows gas production, as represented by steadily dropping gas pressure in tubing 16. At a specified time, for example, when the tubing pressure or gas flow rate drops below a predetermined threshold, the well is shut-in at the surface by controller 34. In other words, the controller 34 commands control valve 48 to close.

When the well is closed-in, the plunger 18 releases from the plunger lubricator 46 and travels down tubing 16 to the bottom of well 10 where it rests on a spring bumper (not shown). Well pressure in the casing 12 will increase as gas accumulates in the annulus between the casing 12 and the tubing 16. Once a threshold gas pressure is reached, control valve 48 is opened and plunger 18, along with the liquid slug 13 in tubing 16 above the plunger 18, are pushed to the surface. As the plunger is lifted to the surface, gas and accumulated liquids above the plunger 18 flow through the outlet pipe(s) 50 and through the main outlet 52. Thereafter, the liquid is generally separated from the gas prior to the gas being measured by the controller 34. When plunger 18 arrives at the well head, it is captured at the plunger catch 46. The gas that accumulated during shut-in, and the gas flowing from the formation, now flows through the outlet pipes 50 to the main outlet 52. When gas flow drops below a threshold point, the well is again shut-in, and the plunger is again allowed to drop down tubing 16. This process is repeated as necessary, often numerous times daily.

Concurrent with the operation of plunger 18, the chemical application assembly periodically applies a calculated amount of chemical to the well in the manner described below. The controller records the last 10 volumes of fluid (slugs) at the end of the flow (open) cycle. According to one embodiment, the slug volume is determined indirectly (i.e. not through direct measurement of fluid flow out of main outlet 52). According to this embodiment, the slug size is determined according to the following equation:

$$(\text{Casing pressure} - \text{Tubing Pressure})/\text{Fluid Gradient}$$

The casing and tubing pressures are determined just prior to opening of the control valve 48 after shut-in. At the controller 34 (or remotely via antenna 36) an operator enters a desired ratio of chemical to slug size. Using the calculated slug size and the input ratio, the controller 34 determines the appropriate volume of chemicals to be added at each cycle. A default pump rate may be used, or the operator may also enter a pump rate. With the chemical volume and the pumping rate known, the controller 34 determines the pumping time to deliver the correct amount of chemicals. The operator must only input the pump rate and chemical ratio once. Thereafter, the settings are maintained in the system unless the pump is replaced or the operator wishes to change the chemical to slug ratio.

After the control valve 48 is closed and the well is shut-in, controller 34 activates the chemical pump 24 for the calculated time to deliver the calculated amount of chemicals. In this manner, chemical foaming agent is delivered to the well in the most effective manner. Specifically, the foaming agent is applied relatively close to the top of the slug. The amount of agent is selected so that excess chemicals are not used. This avoids potential environmental issues, as well as reducing chemical costs. Further, the amount of chemicals added is continuously adjusted based on the running average of the last 10 slug sizes. Thus, the proper amount of chemicals will be added each cycle. According to one embodiment, the chemical pump 24 is initiated immediately after well shut-in. In this manner, the chemicals are injected into the tubing 16 as the plunger 18 is falling down tubing, prior to reaching mandrel 30. By beginning the chemical flow prior to plunger 18 reaching the mandrel 30, the chemicals may be thoroughly mixed into the slug when the plunger 18 arrives and contacts the slug and continues traveling to the bottom of well 10. According to another embodiment, the controller 34 delays starting the pump 24 until after the plunger 18 has fallen past mandrel 30.

Figure 4:
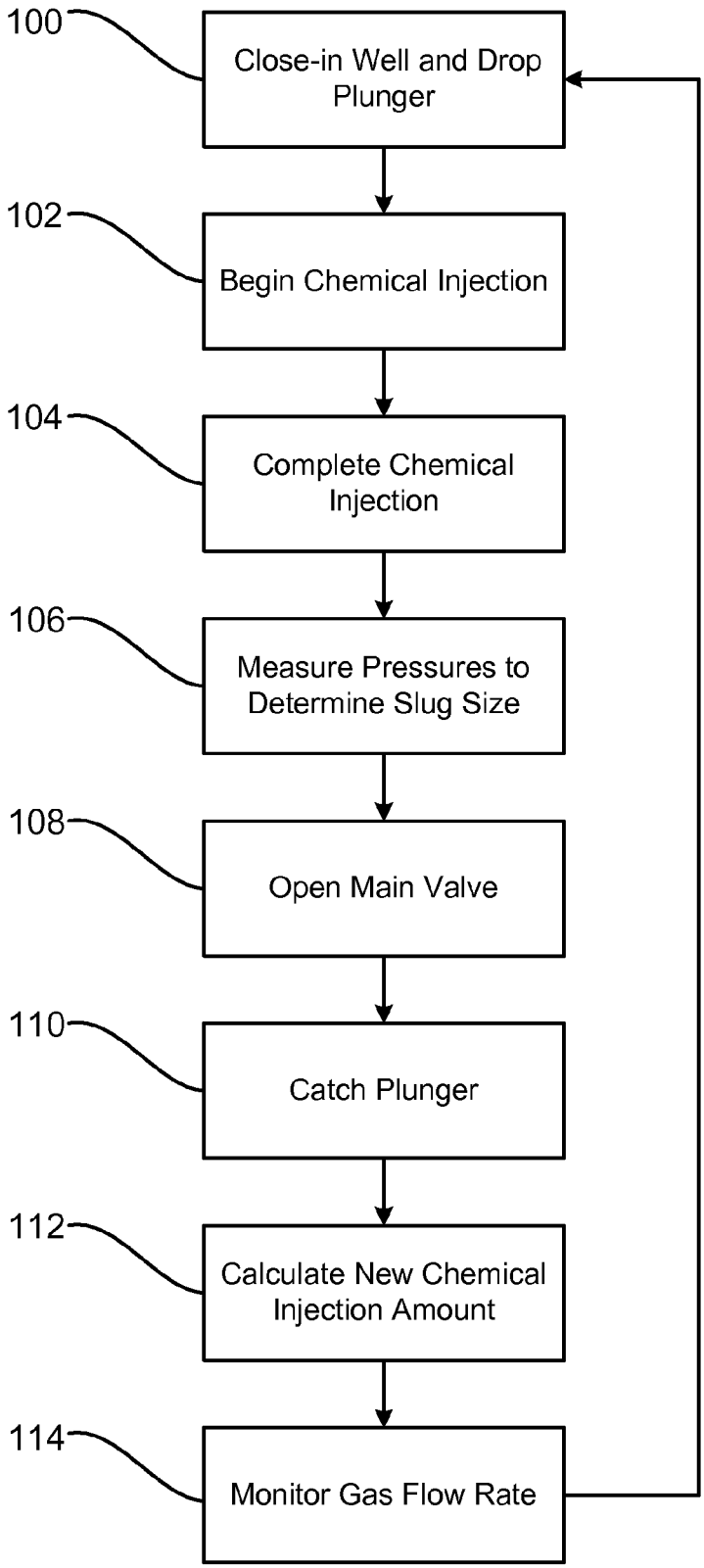
FIG. 4 is a flow-chart of the method of the present invention.

With reference to FIG. 4, a flow-chart of the overall process is shown. At a first step 100, with the plunger 18 located in the plunger lubricator 46, the control valve 48 is closed to shut-in the well. When the well is shut-in, the plunger 18 is allowed to drop down tubing 16. At 102, after well shut-in, the chemical pump 24 is activated by the controller 34. The pump operates at the flow rate and time as calculated by the controller 34. At 104 the chemical injection cycle is completed and controller 34 terminates operation of the chemical pump 24. Thereafter the chemical foaming agent interacts with the liquid slug above plunger 18. At 106, tubing and casing pressures are captured. As discussed above these measurements are then used by the controller 34 to determine the slug size. At 108, after the predetermined time or pressure is reached, controller 34 opens control valve 48. The built-up pressure forces the plunger 18 to the surface, in the process forcing up the liquid slug. At 110 the plunger 18 reaches the surface where it is caught in the plunger lubricator 46. At 112, using the most recent 10 slug size measurements, the controller 34 calculates the amount of chemicals to be added to the next slug, based on inputs described above. Finally, at 114, the gas flow rate is monitored, and when it drops below a predetermined threshold, the loop is repeated, and the controller 34 commands the control valve 48 to shut-in the well.

Chemical foaming agents cause the liquid it contacts to foam, effectively reducing the size and density of the slug. Foaming causes a more permeable surface for gas to foam. This significantly reduces the amount of gas pressure required to lift the plunger. Thus, by using the chemical agents, a plunger lift system can be used for more mature wells. Specifically, as a well matures, the gas pressure slowly decreases. At a certain point, the well can no longer generate sufficient pressure to force the plunger 18 to the surface to remove the slug. In these cases, more costly solutions, such as electric pumps must be used to maintain production from the well. By using the chemical agents, the plunger lift can operate longer, because less well pressure is required (due to smaller slugs) to force the plunger 18 to the surface.

The present invention may be implemented as software, hardware, or a combination thereof. A computer program product implementing the method or a part thereof comprises a software or a computer program run on a general purpose or specially adapted computer such as controller 34, processor, microprocessor or programmable logic controller (PLC). The software includes computer program code elements or software code portions that make the computer perform the steps disclosed above. The program may be stored in whole or part, on, or in, one or more suitable computer readable media or data storage means such as a magnetic disk, CD-ROM or DVD disk, hard disk, magneto-optical memory storage means, in RAM or volatile memory, in ROM or flash memory, as firmware, or on a data server. Such a computer program product can also be supplied via a network, such as Internet.

It is to be understood that the foregoing description has been provided merely for the purpose of explanation and is in no way to be construed as limiting of the invention. Where the invention has been described with reference to embodiments, it is understood that the words which have been used herein are words of description and illustration, rather than words of limitation. Further, although the invention has been described herein with reference to particular structure, materials and/or embodiments, the invention is not intended to be limited to the particulars disclosed herein. Rather, the invention extends to all functionally equivalent structures, methods and uses, such as are within the scope of the appended claims. Those skilled in the art, having the benefit of the teachings of this specification, may effect numerous modifications thereto and changes may be made without departing from the scope and spirit of the invention in its aspects.

I claim:

1. A method of operating a well having an outer casing and a tubing positioned inside the outer casing, a plunger is moveable within the tubing to periodically draw out a liquid slug, the method comprising:

setting a chemical to slug size ratio;

monitoring a gas flow rate;

shutting-in the well when the gas flow rate drops below a predetermined threshold, the plunger falling to the bottom of the tubing during shut-in;

injecting a calculated amount of chemical foaming agent into the tubing after shut-in;

determining the size of the liquid slug;

opening the well when the casing pressure rises above a predetermined threshold, the plunger being forced to the surface of the well; and wherein said calculated amount of chemical foaming agent is calculated based on one or more previous liquid slug size determinations and the set chemical to slug size ratio.

2. The method according to claim 1 wherein said one or more previous liquid slug size determinations further comprises a running average.

3. The method according to claim 2 wherein the running average is calculated from the ten most recent slug size determinations.

4. The method according to claim 1 wherein the step of injecting a calculated amount of chemical foaming agent occurs immediately after the step of shutting-in the well.

5. The method according to claim 1 wherein the step of injecting a calculated amount of chemical foaming agent further includes injecting the chemical foaming agent proximate to a top height of the liquid slug.

6. The method according to claim 1 wherein the step of injecting a calculated amount of chemical foaming agent further includes injecting the chemical foaming agent at a depth greater than at least half the depth of the tubing.

7. The method according to claim 1 wherein said step of determining the size of the liquid slug further comprises subtracting a pressure measurement of the outer casing just prior to opening the well from a pressure measurement of the tubing just prior to opening the well and dividing by the fluid gradient of the liquid slug.

8. An electronic controller device for controlling the operation of a well having an outer casing and a tubing positioned inside the outer casing, a plunger moveable within the tubing to periodically draw out a liquid slug and a chemical injection assembly, the controller comprising:

a processor;

one or more storing units for storing signals;

software program instructions which are stored in one or more of said storing units and when executed by the processor cause the electronic controller device to perform a method comprising:

receiving the input of a chemical to slug size ratio from an operator;

monitoring the flow rate of the gas in the tubing;

shutting-in the well when the gas flow rate in the tubing drops below a predetermined threshold, the plunger being allowed to fall to the bottom of the tubing during shut-in;

instructing the chemical injection assembly to inject a calculated amount of chemical foaming agent into the tubing after shut-in;

determining the size of the liquid slug;

opening the well when the pressure in the casing rises above a predetermined threshold, the plunger thereafter being forced to the surface of the well; and wherein said calculated amount of chemical foaming agent is calculated based on one or more previous liquid slug size determinations and the set chemical to slug size ratio.

9. The device according to claim 8 wherein said one or more previous liquid slug size determinations further comprises a running average.

10. The device according to claim 9 wherein the running average is calculated from the ten most recent slug size determinations.

11. The device according to claim 8 wherein the step of injecting a calculated amount of chemical foaming agent occurs immediately after the step of shutting-in the well.

12. The device according to claim 8 wherein the step of injecting a calculated amount of chemical foaming agent further includes injecting the chemical foaming agent proximate to a top height of the liquid slug.

13. The device according to claim 8 wherein the step of injecting a calculated amount of chemical foaming agent further includes injecting the chemical foaming agent at a depth greater than at least half the depth of the tubing.

14. The device according to claim 8 wherein said step of determining the size of the liquid slug further comprises subtracting a pressure measurement in the outer casing just prior to opening the well from a pressure measurement in the tubing just prior to opening the well and dividing by the fluid gradient of the liquid slug.

15. The device according to claim 8 wherein said well further includes a control valve, and the step of closing-in the well comprises instructing the control valve to close.

16. The device according to claim 15 wherein said step of opening the well comprises instructing the control valve to open.

* * * * *